US007994884B2

(12) United States Patent
Kuo

(10) Patent No.: US 7,994,884 B2
(45) Date of Patent: Aug. 9, 2011

(54) ELECTROMAGNETIC RELAY

(75) Inventor: Ming-Chang Kuo, Taichung (TW)

(73) Assignee: Good Sky Electric Co., Ltd., Taichung (TW)

( * ) Notice: Subject to any disclaimer, the term of this patent is extended or adjusted under 35 U.S.C. 154(b) by 180 days.

(21) Appl. No.: 12/432,152

(22) Filed: Apr. 29, 2009

(65) Prior Publication Data

US 2010/0117769 A1 May 13, 2010

(30) Foreign Application Priority Data

Nov. 12, 2008 (TW) ..... 97143683 A

(51) Int. Cl.
*H01H 51/22* (2006.01)

(52) U.S. Cl. ..... 335/78; 335/83

(58) Field of Classification Search ..... 335/78, 335/80, 83

See application file for complete search history.

(56) References Cited

U.S. PATENT DOCUMENTS

| | | | | |
|---|---|---|---|---|
| 5,202,663 | A * | 4/1993 | Tomono et al. | 335/86 |
| 5,289,144 | A * | 2/1994 | Liao | 335/78 |
| 5,392,015 | A * | 2/1995 | Matsuoka et al. | 335/78 |
| 5,497,132 | A * | 3/1996 | Mader | 335/78 |
| 5,719,541 | A * | 2/1998 | Mader | 335/78 |
| 5,757,255 | A * | 5/1998 | Noda et al. | 335/78 |
| 5,864,270 | A * | 1/1999 | Hoffman | 335/78 |
| 5,969,586 | A * | 10/1999 | Noda et al. | 335/83 |
| 6,486,760 | B2 * | 11/2002 | Miyazaki et al. | 335/78 |
| 6,606,018 | B2 * | 8/2003 | Takano et al. | 335/78 |
| 6,731,190 | B2 * | 5/2004 | Yamashita et al. | 335/78 |

* cited by examiner

*Primary Examiner* — Elvin G Enad
*Assistant Examiner* — Alexander Talpalatskiy
(74) *Attorney, Agent, or Firm* — Nixon & Vanderhye P.C.

(57) ABSTRACT

An electromagnetic relay includes: a casing formed with an opening; a relay core member adapted for generating an electromagnetic field and inserted into the casing through the opening; an actuating set that is inserted into the relay core member, that is exposed from the casing, and that can be driven by a magnetic attraction force attributed to the electromagnetic field; a terminal set disposed on the casing and adapted to be actuated by the actuating set to thereby act as a switch mechanism; and a housing accommodating the casing, the relay core member, the actuating set and the terminal set.

5 Claims, 7 Drawing Sheets

ELECTROMAGNETIC RELAY

CROSS-REFERENCE TO RELATED APPLICATION

This application claims priority of Taiwanese Application No. 097143683, filed on Nov. 12, 2008.

BACKGROUND OF THE INVENTION

1. Field of the Invention

The present invention relates to an electromagnetic relay, more particularly to an electromagnetic relay that is easy to assemble accurately and has a relatively higher breakdown voltage value.

2. Description of the Related Art

Referring to FIGS. 1 and 2, a conventional electromagnetic relay 1 includes a relay core member 11, a casing 12 for mounting of the relay core member 11, an actuating set 13, a terminal set 14, and a housing 15 for accommodating the relay core member 11, the casing 12, the actuating set 13 and the terminal set 14. The relay core member 11 includes a first mounting frame 112, a coil 111 wound around the first mounting frame 112, a yoke component 113 abutting against two adjacent sides of the coil 111, a magnetic core 114 extending through the coil 111 and connected to the yoke component 113, a second mounting frame 115 connected to the first mounting frame 112, and a pair of conductive pins 116 inserted through the second mounting frame 115 and electrically connected to the coil 111. The actuating set 13 includes a resilient component 131 riveted on the yoke component 113, a magnetic component 132 pivotable between the resilient component 131 and the first mounting frame 112, and a drive component 133 connected to the magnetic component 132 and driven thereby. The terminal set 14 includes first, second and third terminals 141, 142 and 142 which are disposed on the casing 12. The third terminal 143 is disposed between the first and second terminals 141, 142, and is connected to and driven by the drive component 133.

The conventional electromagnetic relay 1 has the following disadvantages. First, the configuration of connecting the first and second mounting frame 112, 115 is easily broken. Second, riveting of the resilient component 131 on the yoke component 113, and improper positioning of the magnetic component 132 relative to the first mounting frame 112 result in complex and difficult assembly of the relay 1. Moreover, the casing 12 has an open configuration such that the relay core member 11 of the conventional electromagnetic relay 1 cannot be electromagnetically isolated very well, and is susceptible to interference from the surroundings. Further, assembly accuracy is relatively poor due to the open configuration of the casing 12 such that the conventional electromagnetic relay 1 has a relatively lower breakdown voltage value.

SUMMARY OF THE INVENTION

Therefore, an object of the present invention is to provide an electromagnetic relay that is easy to assemble, that costs relatively less for manufacturing, and that has a relatively higher breakdown voltage value.

Accordingly, an electromagnetic relay of the present invention comprises a casing, a relay core member, an actuating set, a terminal set, and a housing.

The casing has a first side formed with an opening and a second side opposite to the first side. The relay core member is adapted for generating an electromagnetic field, is inserted into the casing through the opening, and is formed with a recess having first and second positioning portions which are exposed from the casing.

The actuating set includes an elongate magnetic component and a resilient component. The elongate magnetic component is inserted into the first positioning portion of the recess in the relay core member, and extends along a direction generally perpendicular to a direction of the electromagnetic field generated by the relay core member. The elongate magnetic component is pivotable between a first position and a second position. The resilient component is inserted into the second positioning portion of the recess in the relay core member and pressing against the magnetic component for providing a resilient force thereto. When the electromagnetic field is generated, the magnetic component is at the second position. When the electromagnetic field is not generated, the magnetic component is biased to the first position.

The terminal set includes first, second and third terminals which are disposed on the casing. The third terminal is disposed between the first terminal and the second terminal, and is biased to contact the first terminal when the magnetic component is at the first position. The actuating set actuates the third terminal to contact the second terminal when the magnetic component is moved from the first position to the second position. The housing accommodates the casing, the relay core member, the actuating set and the terminal set.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
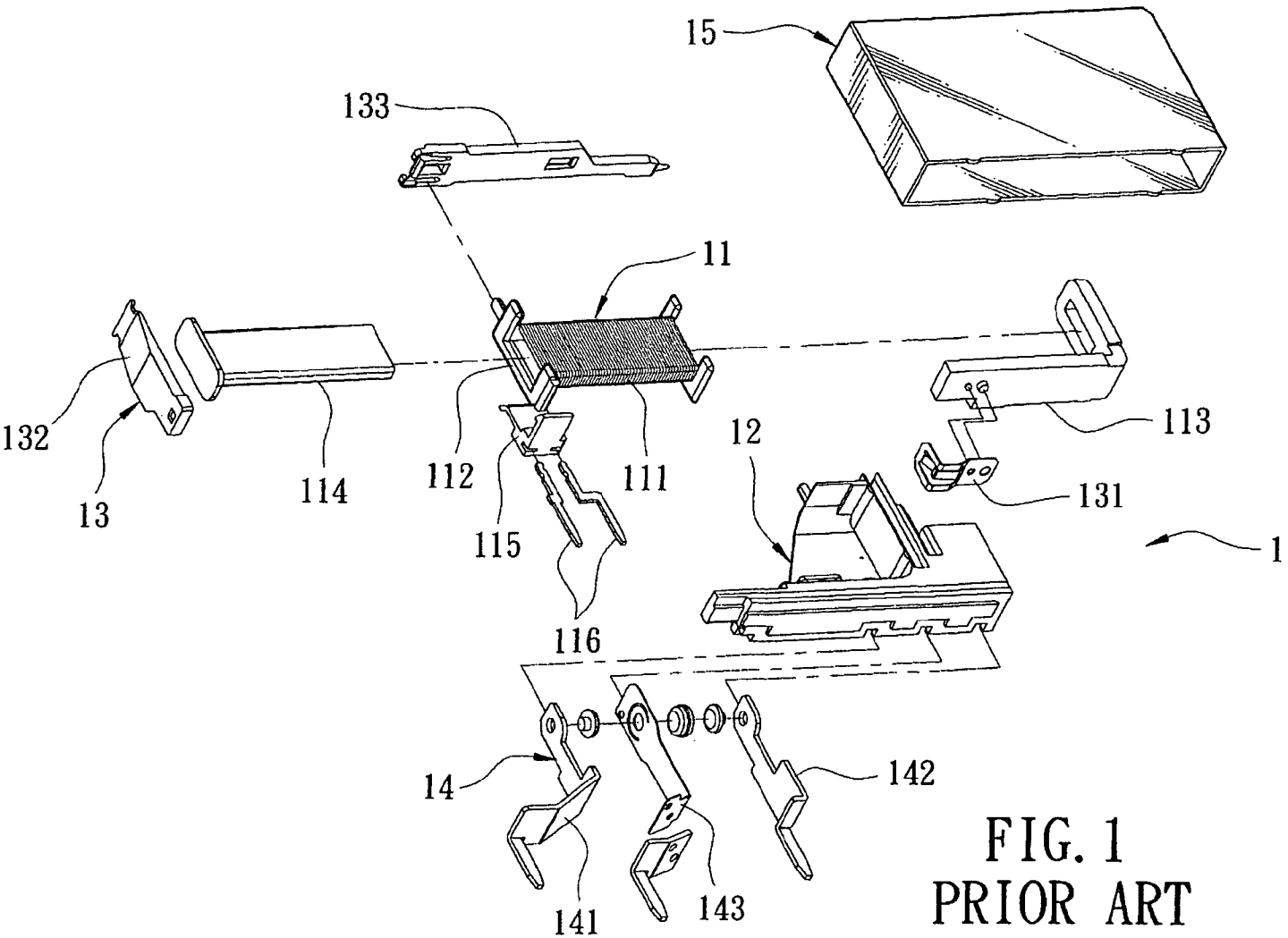
FIG. 1 PRIOR ART
FIG. 1 is an exploded perspective view illustrating a conventional electromagnetic relay.
Figure 2:
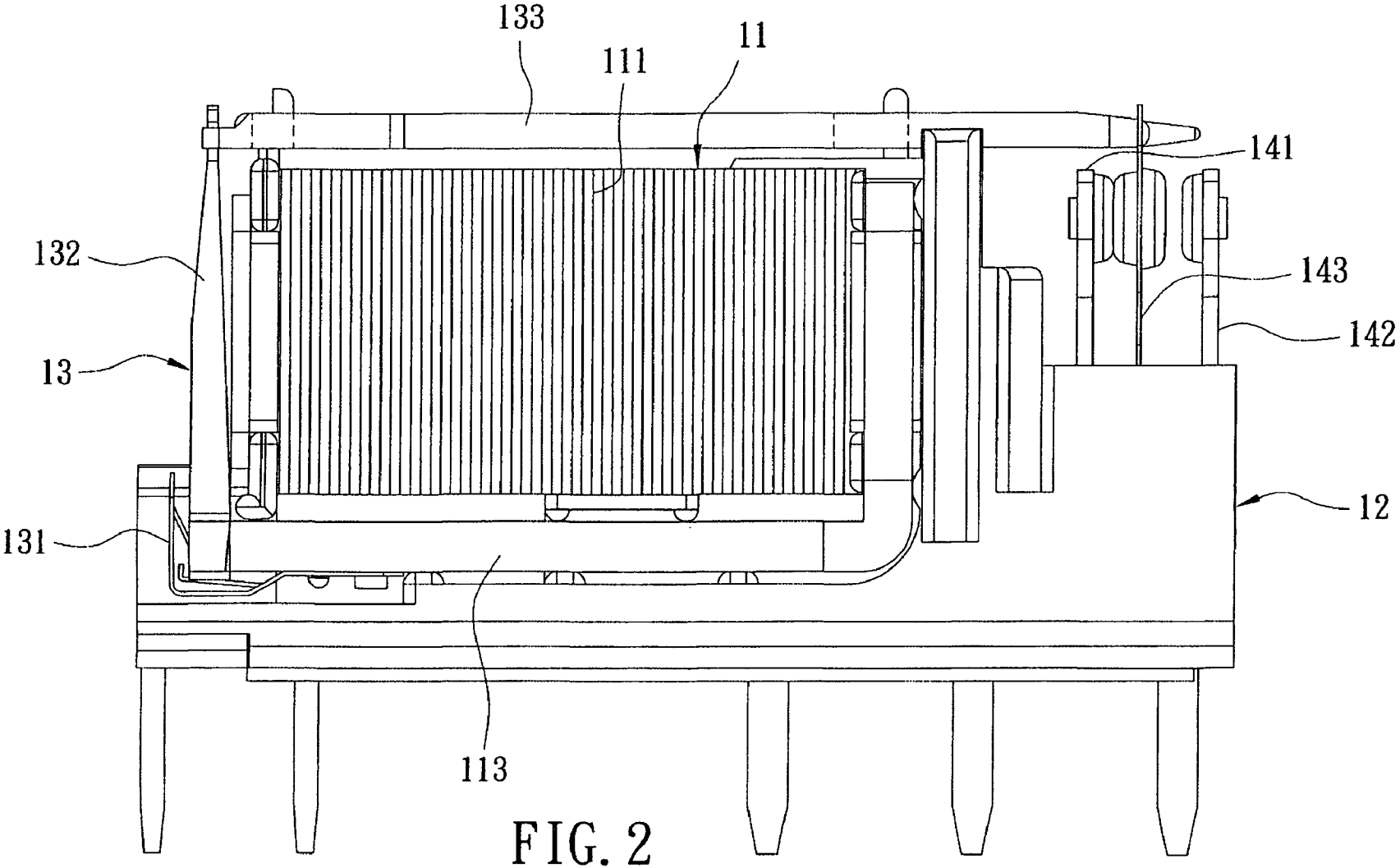
FIG. 2 PRIOR ART
FIG. 2 is a front view of the conventional electromagnetic relay.
Figure 3:
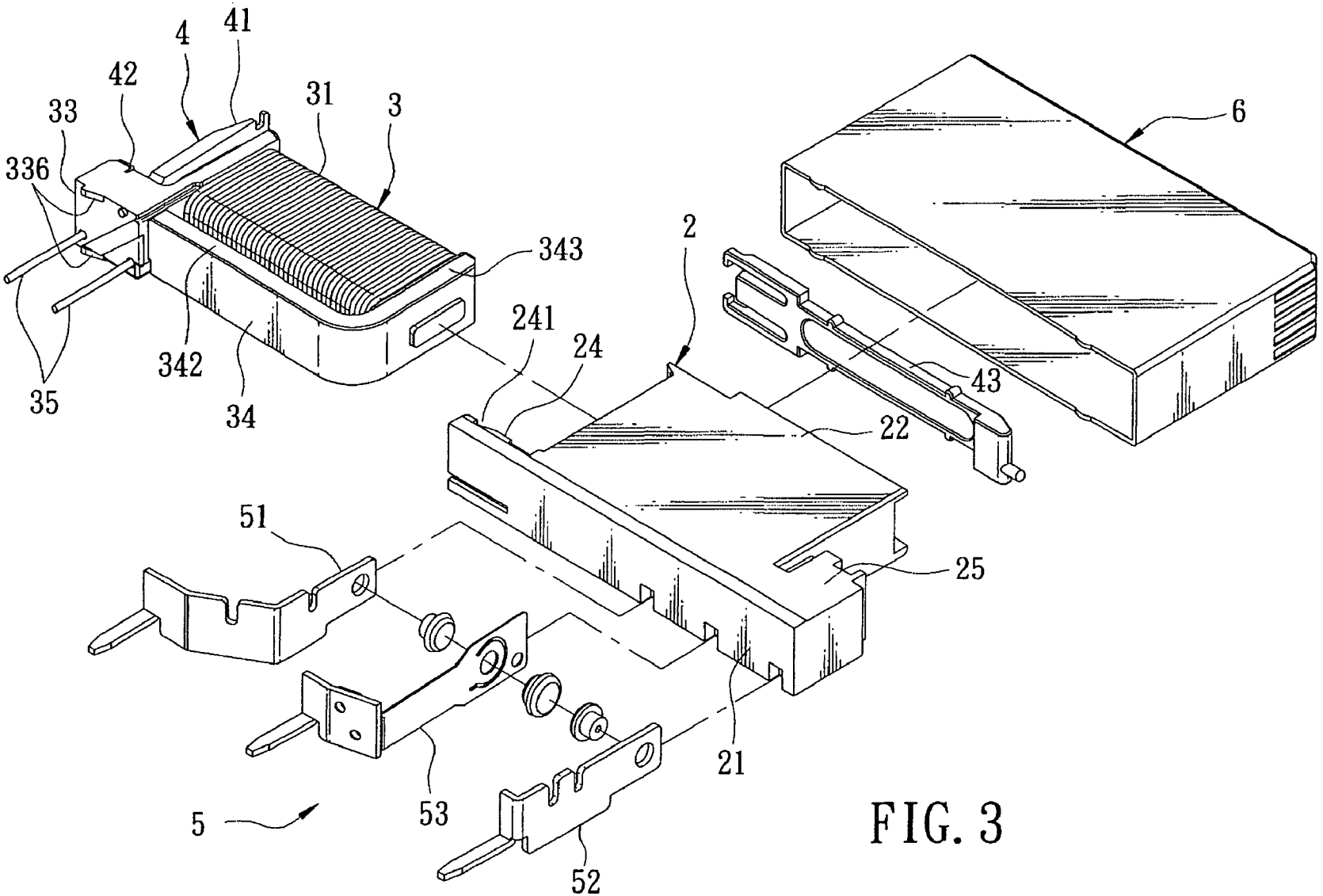
FIG. 3 is an exploded perspective view illustrating the preferred embodiment of the electromagnetic relay of the present invention.
Figure 4:
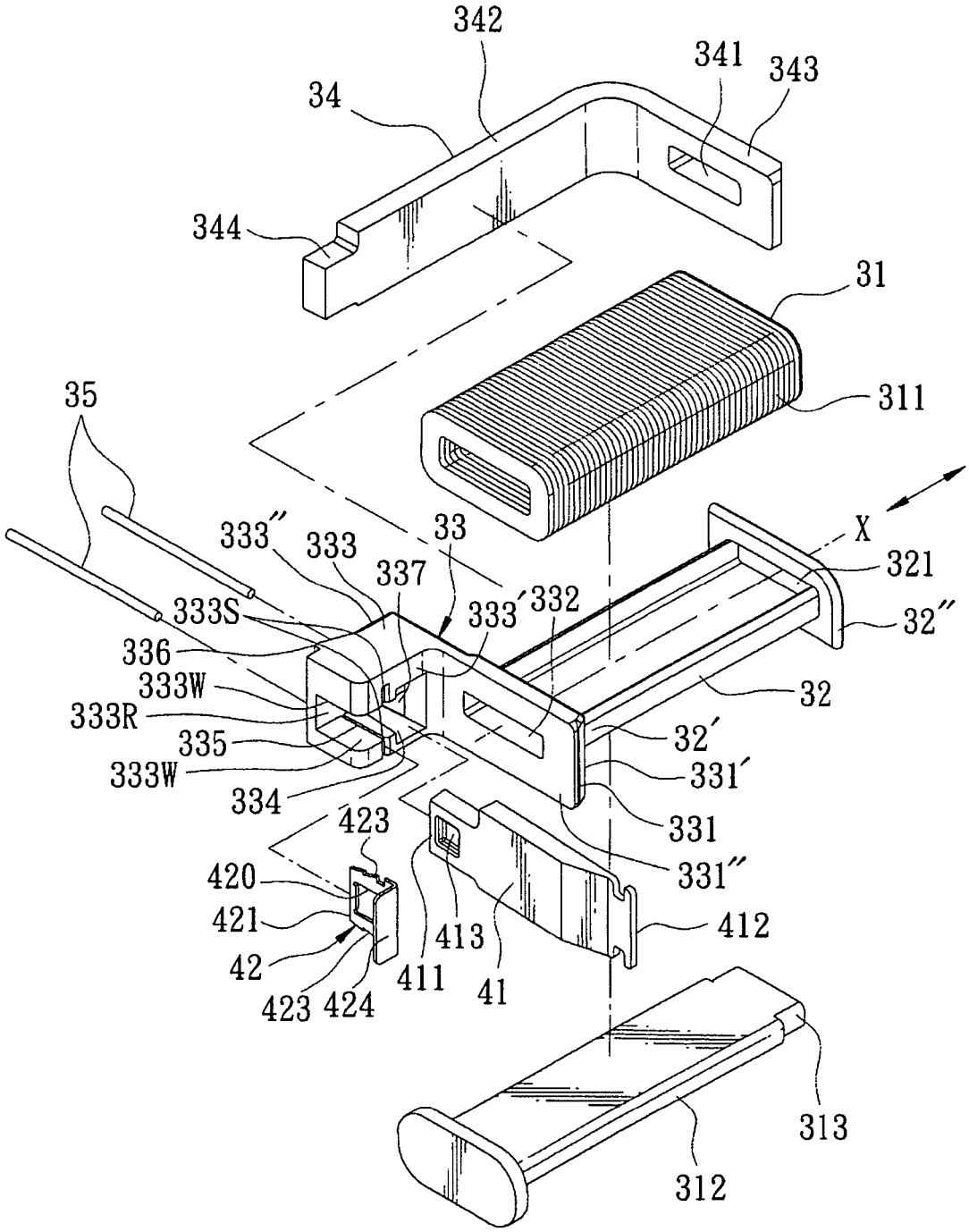
FIG. 4 is an exploded perspective view illustrating a relay core member of the electromagnetic relay of the preferred embodiment.
Figure 5:
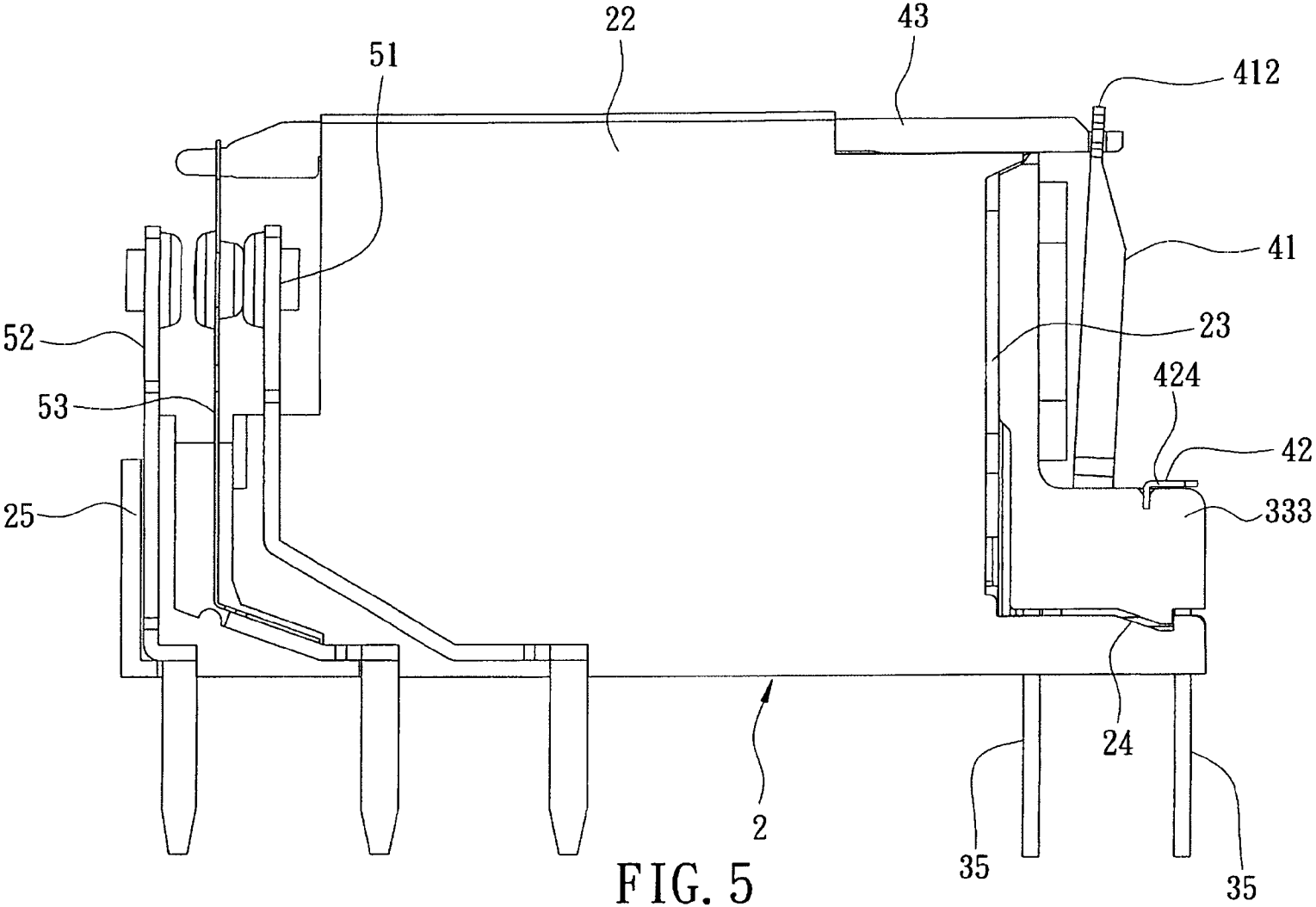
FIG. 5 is a rear view of the preferred embodiment.

Referring to FIG. 3, an electromagnetic relay of the preferred embodiment includes a casing 2, a relay core member 3, an actuating set 4, a terminal set 5 and a housing 6.

Referring to FIGS. 3 to 6, the casing 2 has an opening 23 (see FIG. 5), and includes an elongate bottom plate 21, a block-engaging unit 24 formed with two engaging grooves 241 (only one is shown in FIG. 3) and disposed on an end of the bottom plate 21 proximate to the opening 23, a terminal-mounting unit 25 disposed on an opposite end of the bottom plate 21 for mounting the terminal set 5, and a casing body 22 disposed on an intermediate position of the bottom plate 21 and formed with the opening 23.

The relay core member 3 is adapted for generating an electromagnetic field, and includes a coil unit 31, a first mounting frame 32 for mounting the coil unit 31 thereon and disposed within the casing 2, a second mounting frame 33 connected fixedly to the first mounting frame 32 for sealing the opening 23 in the casing 2 and formed with a recess (333R), an L-shaped limiting component 34, and a pair of conductive pins 35. The coil unit 31 includes a coil 311 wound around the first mounting frame 32, and a magnetic core 312 extending through the coil 311 and the second mounting frame 33 along the direction (X) of the electromagnetic field. The magnetic core 312 includes a neck 313 projecting therefrom.

Preferably, the first and second mounting frames 32, 33 are formed integrally. The first mounting frame 32 includes a connecting end 32' and a non-connecting end 32" opposite to the connecting end 32' and formed with a first through hole 321. The second mounting frame 33 includes an elongate transverse plate 331 extending along a direction perpendicular to the direction (X) and formed with a second through hole 332, an engaging block 333 exposed from the casing 2 and formed with the recess (333R), and two barbs 336 disposed on the engaging block 333 and engaging the engaging grooves 241 in the block-engaging unit 24 of the casing 2. The elongate transverse plate 331 has a first side surface 331' connected fixedly to the connecting end 32' of the first mounting frame 32, and a second side surface 331" opposite to the first side surface 331'. The engaging block 333 extends integrally from the second side surface 331" of the transverse plate 331 along the direction (X) and has a first side surface 333' formed with the recess (333R) and an opposite second side surface 333".

The recess (333R) is defined by two opposite inner surfaces (333W), and has a first positioning portion 334 and a second positioning portion 335. The inner surfaces (333W) are formed with two aligned slots (333S) that constitute cooperatively the second positioning portion 335.

Moreover, the transverse plate 331 further has a neck-engaging hole 337 formed at a position where the engaging block 333 extends from the transverse plate 331. The limiting component 34 has a connecting plate part 342 connected to the transverse plate 331, a limiting plate part 343 perpendicular to the connecting plate part 342, and a neck 344 projecting from the connecting plate part 342. The limiting plate part 343 abuts against the non-connecting end 32" of the first mounting frame 32, and has a third through hole 341 formed through the limiting plate part 343. The neck 344 fittingly engages the neck-engaging hole 337 in the transverse plate 331. The magnetic core 312 extends through the first through hole 321 and the second through hole 332, and the neck 313 of the magnetic core 312 fittingly engages the third through hole 341, such that removal of the magnetic core 312 from the first mounting frame 32 through the first through hole 321 is prevented. The conductive pins 35 are inserted through the engaging block 333 of the second mounting frame 33, and are electrically connected to the coil 311.

Figure 6:
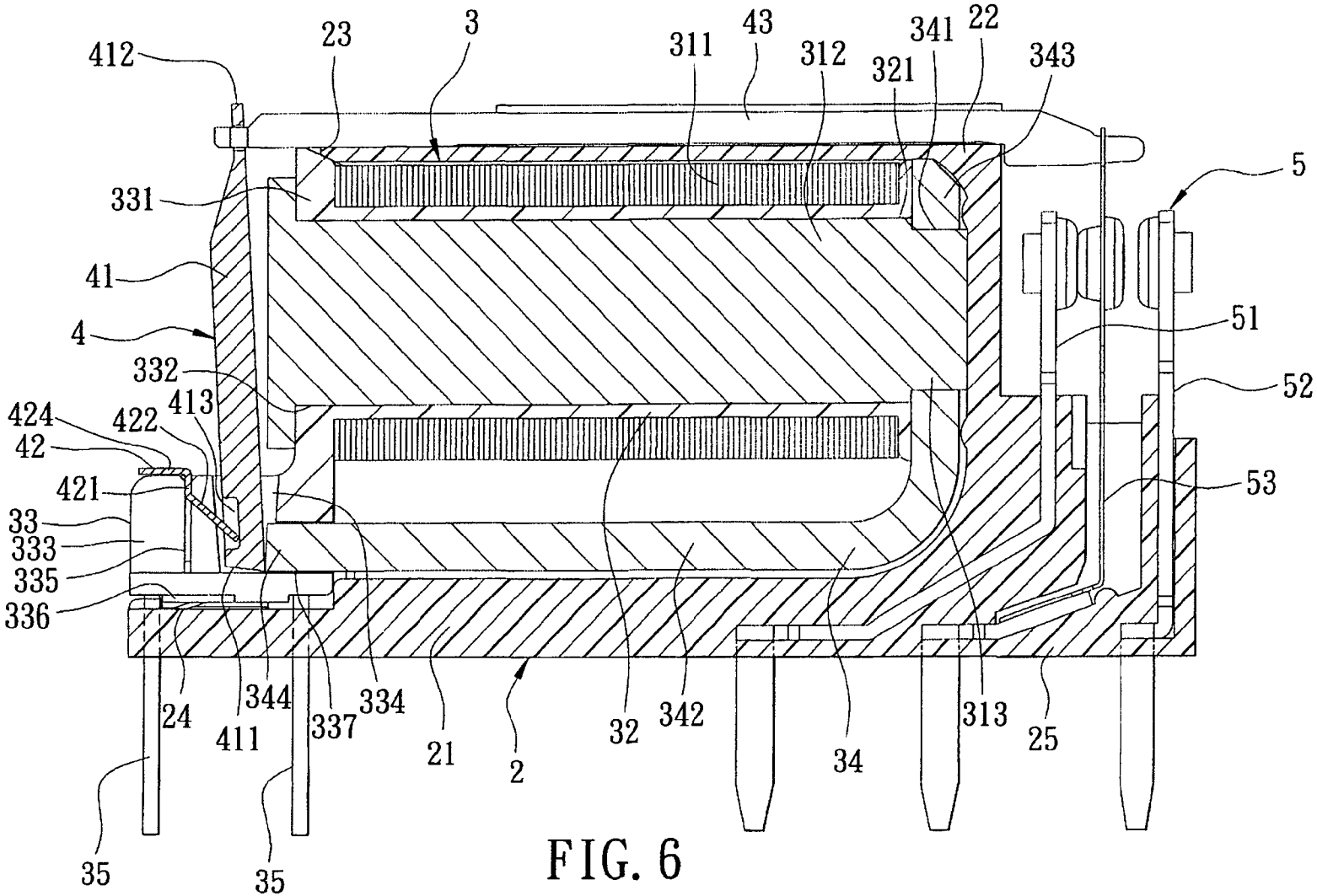
FIG. 6 is a sectional view illustrating the preferred embodiment in a state where a third terminal contacts a first terminal.
Figure 7:
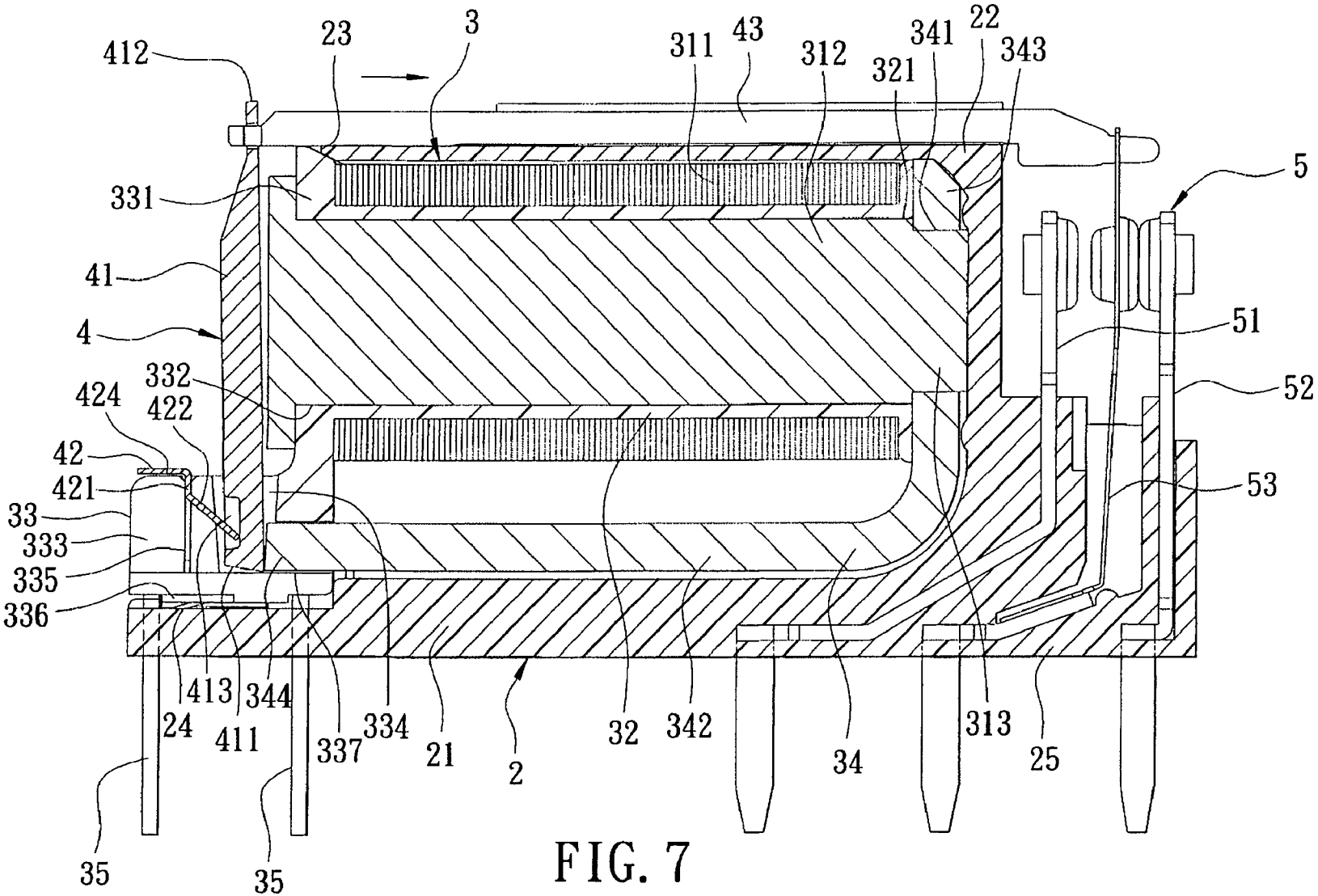
FIG. 7 is a sectional view illustrating the preferred embodiment in a state where the third terminal contacts a second terminal.

The actuating set 4 includes an elongate magnetic component 41 inserted into the first positioning portion 334 of the recess (333R) in the engaging block 333 and extending along a direction generally perpendicular to the direction (X), a resilient component 42 inserted into the second positioning portion 335 of the recess (333R) in the engaging block 333, and a drive component 43 extending along the direction (X) for connecting the magnetic component 41 with the terminal set 5. The magnetic component 41 is pivotable between a first position and a second position. When the electromagnetic field is generated, the magnetic component 41 is at the second position, as shown in FIG. 7. When the electromagnetic field is not generated, the magnetic component 41 is biased to the first position, as shown in FIG. 6.

The magnetic component 41 includes an insertion end 411 inserted into the first positioning portion 334 of the recess (333R) in the engaging block 333 and formed with a hole 413 in a surface facing the resilient component 42, and a traction end 412 connected to the drive component 43. Preferably, the magnetic component 41 is longer than the transverse plate 331. The resilient component 42 includes a frame 421 having an inner periphery 420, a resilient arm 422 connected integrally and inclinedly to the inner periphery 420, inserted into the hole 413, and pressing against the magnetic component 41 for providing a resilient force to the magnetic component 41, a pair of barbs 423 extending respectively from two opposite sides of the frame 421 away from each other and anchored in the slots (332S), respectively, and a limiting plate 424 perpendicularly connected to the frame 421 and exposed from the recess (333R). The limiting plate 424 abuts against the engaging block 333 for positioning the frame 421 of the resilient component 42 within the second positioning portion 335 of the recess (333R) in the engaging block 333.

The terminal set 5 includes first, second and third terminals 51, 52 and 53 which are disposed on the terminal-mounting unit 25 of the casing 2 such that the terminal set 5 and the opening 23 are disposed respectively at two opposite sides of the casing 2, wherein the third terminal 53 is disposed between the first terminal 51 and the second terminal 53, and is connected to the drive component 43 of the actuating set 4. The third terminal 53 is biased to contact the first terminal 51 when the magnetic component 41 is at the first position, and the drive component 43 of the actuating set 4 actuates the third terminal 53 to contact the second terminal 52 when the magnetic component 41 is moved from the first position to the second position.

The housing 6 accommodates the casing 2, the relay core member 3, the actuating set 4 and the terminal set 5.

Referring to FIG. 7, when the coil 311 is energized via the conductive pins 35, the electromagnetic field is generated to attract and move the magnetic component 41 to the second position. At the same time, the traction end 412 of the magnetic component 41 drives the drive component 43 to actuate the third terminal 53 to contact the second terminal 52. Referring to FIG. 6, when the coil 311 is not energized, there is no electromagnetic field generated to attract the magnetic component 41, and therefore the third terminal 53 is biased to contact the first terminal 51 in a known manner due to a resilient force thereof, and actuates the drive component 43 to push the traction end 412 away from the coil unit 31 to thereby bias the magnetic component 41 to the first position.

In sum, the electromagnetic relay of the present invention has the following advantages. First, because the magnetic component 41 and the resilient component 42 are inserted respectively into the first and second positioning portions 334, 335 of the recess (333R) in the engaging block 333, it is relatively easy to assemble the electromagnetic relay of the present invention so as to enhance the assembly accuracy. Therefore, an automated manufacturing process can be utilized for the electromagnetic relay of the present invention. Second, the second mounting frame 33 seals the opening 23 in the casing 2 for isolating electromagnetically the coil unit 31 to thereby minimize electromagnetic interference from the surroundings and maintain an effective magnetic attraction for the magnetic component 41. Third, because the first and second mounting frames 32, 33 are formed integrally, and the engaging block 33 extends integrally from the second side surface 331" of the transverse plate 331, the configuration of the electromagnetic relay of the present invention is relatively strong. Additionally, under the same magnetic attraction of the electromagnetic field, since the magnetic component 41 is longer than the transverse plate 331, a relatively long moment arm associated with a force applied to the third terminal 53 can be obtained to thereby enhance switching accuracy of the terminal set 5.

According to the above-mentioned advantages, it has been verified through experiments that the electromagnetic relay of the present invention has a breakdown voltage value much higher than that of a conventional electromagnetic relay. Therefore, the service life of the electromagnetic relay of the present invention is relatively longer.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An electromagnetic relay comprising:

a casing formed with an opening;

a relay core member adapted for generating an electromagnetic field and inserted into said casing through said opening, said relay core member being formed with a recess having a first positioning portion and a second positioning portion which are exposed from said casing, said relay core member including a first mounting frame being disposed within said casing, and including a connecting end and a non-connecting end opposite to said connecting end and formed with a first through hole, a second mounting frame including an elongate transverse plate being formed with a second through hole, and having a first side surface connected fixedly to said connecting end of said first mounting frame for sealing said opening in said casing, and a second side surface opposite to said first side surface, and an engaging block extending integrally from said second side surface of said transverse plate and having opposite first and second side surfaces, said first side surface of said engaging block being formed with said recess, an L-shaped limiting component having a connecting plate part connected to said transverse plate, and a limiting plate part that is perpendicular to said connecting plate part, that abuts against said non-connecting end of said first mounting frame, and that has a third through hole formed through said limiting plate part, and a coil unit including a coil wound around said first mounting frame, and a magnetic core extending through said coil and said second mounting frame along the direction of the electromagnetic field, said magnetic core extending through said first through hole, said second through hole and said third through hole such that removal of said magnetic core from said first mounting frame through said first through hole is prevented;

an actuating set including an elongate magnetic component that is inserted into said first positioning portion of said recess in said relay core member and extending along a direction generally perpendicular to a direction of the electromagnetic field generated by said relay core member, and that is pivotable between a first position and a second position, and a resilient component inserted into said second positioning portion of said recess in said relay core member and pressing against said magnetic component for providing a resilient force thereto, wherein said magnetic component is at said second position when the electromagnetic field is generated, and is biased to said first position when the electromagnetic field is not generated;

a terminal set including first, second and third terminals which are disposed on said casing, said third terminal being disposed between said first terminal and said second terminal, wherein said third terminal is biased to contact said first terminal when said magnetic component is at said first position, and said actuating set actuates said third terminal to contact said second terminal when said magnetic component is moved from said first position to said second position; and a housing accommodating said casing, said relay core member, said actuating set and said terminal set;

wherein said casing includes an elongate bottom plate, a block-engaging unit formed with an engaging groove and disposed on an end of said bottom plate proximate to said opening, a terminal-mounting unit disposed on an opposite end of said bottom plate, and a casing body disposed on an intermediate position of said bottom plate;

wherein said second mounting frame further includes a barb disposed on said second side surface of said engaging block, and engaging said engaging groove of said casing.

2. The electromagnetic relay as claimed in claim 1, wherein:

said actuating set further includes a drive component connecting said magnetic component with said third terminal of said terminal set; and said magnetic component of said actuating set includes an insertion end inserted into said first positioning portion of said recess in said engaging block, and a traction end connected to said drive component, said magnetic component being longer than said transverse plate.

3. An electromagnetic relay comprising:

a casing formed with an opening;

a relay core member adapted for generating an electromagnetic field and inserted into said casing through said opening, said relay core member being formed with a recess having a first positioning portion and a second positioning portion which are exposed from said casing;

an actuating set including an elongate magnetic component that is inserted into said first positioning portion of said recess in said relay core member and extending along a direction generally perpendicular to a direction of the electromagnetic field generated by said relay core member, and that is pivotable between a first position and a second position, and a resilient component inserted into said second positioning portion of said recess in said relay core member and pressing against said magnetic component for providing a resilient force thereto, wherein said magnetic component is at said second position when the electromagnetic field is generated, and is biased to said first position when the electromagnetic field is not generated;

a terminal set including first, second and third terminals which are disposed on said casing, said third terminal being disposed between said first terminal and said second terminal, wherein said third terminal is biased to contact said first terminal when said magnetic component is at said first position, and said actuating set actuates said third terminal to contact said second terminal when said magnetic component is moved from said first position to said second position; and a housing accommodating said casing, said relay core member, said actuating set and said terminal set;

wherein said resilient component of said actuating set includes a pair of barbs extending respectively from two opposite sides thereof away from each other and anchored in said second positioning portion of said recess.

4. An electromagnetic relay comprising:

a casing formed with an opening;

a relay core member adapted for generating an electromagnetic field and inserted into said casing through said opening, said relay core member being formed with a recess having a first positioning portion and a second positioning portion which are exposed from said casing;

an actuating set including an elongate magnetic component that is inserted into said first positioning portion of said recess in said relay core member and extending along a direction generally perpendicular to a direction of the electromagnetic field generated by said relay core member, and that is pivotable between a first position and a second position, and a resilient component inserted into said second positioning portion of said recess in said relay core member and pressing against said magnetic component for providing a resilient force thereto, said resilient component including a frame having an inner periphery, and a resilient arm connected integrally and inclinedly to said inner periphery and abutting against said magnetic component for providing the resilient force to said magnetic component, wherein said magnetic component is at said second position when the electromagnetic field is generated, and is biased to said first position when the electromagnetic field is not generated;

a terminal set including first, second and third terminals which are disposed on said casing, said third terminal being disposed between said first terminal and said second terminal, wherein said third terminal is biased to contact said first terminal when said magnetic component is at said first position, and said actuating set actuates said third terminal to contact said second terminal when said magnetic component is moved from said first position to said second position; and a housing accommodating said casing, said relay core member, said actuating set and said terminal set;

wherein said resilient component of said actuating set further includes a limiting plate perpendicularly connected to said frame and exposed from said recess, said limiting plate abutting against said engaging block for positioning said frame of said resilient component within said second positioning portion of said recess.

5. The electromagnetic relay as claimed in claim 1, wherein said terminal set and said opening are disposed respectively at two opposite sides of said casing, and said actuating set further includes a drive component connecting said magnetic component with said third terminal of said terminal set.

* * * * *